United States Patent [19]

Kirchhoff et al.

[11] 4,097,252

[45] Jun. 27, 1978

[54] ELECTROSTATIC PRECIPITATOR

[75] Inventors: Franz-Josef Kirchhoff, Olpe; Joachim Brandt, Rothemuhle, both of Germany

[73] Assignee: Apparatebau Rothemuhle Brandt & Kritzler, Rothemuhle, Germany

[21] Appl. No.: 673,589

[22] Filed: Apr. 5, 1976

[30] Foreign Application Priority Data

Apr. 5, 1975 Germany ..... 2514956

[51] Int. Cl.[2] ..... B03C 3/01

[52] U.S. Cl. ..... 55/135; 55/136; 110/119

[58] Field of Search ..... 55/2, 11, 124–133, 55/135–138; 165/145, 4; 110/56, 119; 122/DIG. 1

[56] References Cited

U.S. PATENT DOCUMENTS

| | | | |
|---|---|---|---|
| 1,794,615 | 3/1931 | Hoss | 55/136 |
| 1,859,573 | 5/1932 | Riley | 165/4 |
| 2,626,676 | 1/1953 | Phyl et al. | 55/133 |
| 3,233,664 | 2/1966 | Jacobs | 165/145 |
| 3,365,858 | 1/1968 | Penney | 55/11 |
| 3,631,655 | 1/1972 | Mullen | 110/119 |

*Primary Examiner*—Bernard Nozick
*Attorney, Agent, or Firm*—Lockwood, Dewey, Zickert & Alex

[57] ABSTRACT

A horizontal-flow electrostatic filter for gas passing from a boiler to a chimney and having separate flow chambers lying horizontally side-by-side has inlet and outlet ducting arranged such that flue gases are divided to flow in opposite directions through the respective chambers, both directions of flow being at right angles to the direction of the shortest distance between the boiler house and the chimney. The flue gas output of the boiler is divided equally between the chambers. The size and hence capacity of the filter may be greater, in this disposition, for a given said distance than if a prior art parallel co-current flow arrangement (shown in FIG. 1 of the drawings) were used. Capacity for a given available floor space is further assisted by providing a plurality of arrays of collection and discharge electrodes separately electrically supplied and controlled.

12 Claims, 2 Drawing Figures

ELECTROSTATIC PRECIPITATOR

FIELD OF THE INVENTION

The invention relates to a horizontal flow electrostatic precipitator or filter, for flue gas.

BACKGROUND OF THE INVENTION

It is known that such filters for purifying the flue gases of a steam boiler installation may be subdivided in the direction of flow by one or more gastight partitions and have separate connection ducts for the admission and the discharge of different partial amounts of flue gas so that distinct and separate chamber spaces are defined. In each of these collection and discharge electrodes are installed in such a manner that they form a plurality of electrically independent precipitation fields which are connected to respective and separately controlled high-tension rectifier units. The fields in each chamber are passed through seriatim by the flowing gas. The collection electrodes are usually of strip metal form and the discharge electrodes of wire.

Because of the ever-increasing outputs of boilers, electrostatic filters of this kind must likewise be increased in capacity in order to be able to comply with legal requirements concerning the purity of the waste gases which are finally discharged. The problem of providing space for these electrostatic filter plants has therefore become increasingly difficult, since capacity has been a function of size. In determining the size of such plants a main essential factor is the legal requirement that even in the event of the failure of one of the electric fields the prescribed dust content of the purified gas must not be exceeded. This is possible only if in electrostatic filter units of increasingly large size there has been a greater subdivision into a larger number of electrically separate precipitation fields within each chamber of the filter.

Under these conditions the speeds of flow necessary for complying with the guarantee must be kept within certain limits within the electrical precipitation fields in dependence on the type of firing and the composition of the fuel (for example between 1.0 and 1.3 meter per second for mineral coal firing and between 1.6 and 2 meters per second for brown coal firing). Thus, the cross-sections of electrostatic filters have become increasingly great, and because the optimum cross-sectional heights of the electric fields customary at the present time, that is to say a maximum of 13.5 meters, will scarcely be able to be exceeded in the future, this implies increasing the width of the filter as a whole which also can only be done up to a certain limit.

The necessary enlargement of the volume of an electrostatic filter is therefore most expediently made only by increasing the length of the filter traversed by the gas in its horizontal flow. But then, where space is restricted it may not be possible to accommodate such a large electrostatic filter with the ground plan arrangement hitherto customary (as shown in FIG. 1) with its longitudinal axis in the direction of flow, within the distance between the boiler house and the chimney.

SUMMARY OF THE INVENTION

The present invention therefore seeks to construct a horizontal flow electrostatic filter in such a manner that in order to achieve a greater saving of space it can be installed with its longitudinal axis at right angles, in ground plan, to the distance between the boiler house and the chimney. This means that in a given said distance an electrostatic filter can be installed, on one level, which is of greater capacity than would have been possible in the prior art.

According to the invention flue gas inlet ducts for respective ones of the plurality of separate chambers and the corresponding outlet ducts therefrom are connected at opposite ends of the electrostatic filter casings in such a manner that the separate chambers are to be passed through in opposite directions by fractions of the total throughput of the flue gas.

To further increase the capacity of the installation the electrostatic filter of the invention may be connected in parallel to a second horizontal-flow flue gas electrostatic filter and can be disposed above the latter.

DESCRIPTION OF THE DRAWINGS

In the accompanying drawings, which are somewhat diagrammatic.

DESCRIPTION OF PRIOR ART

Figure 1:
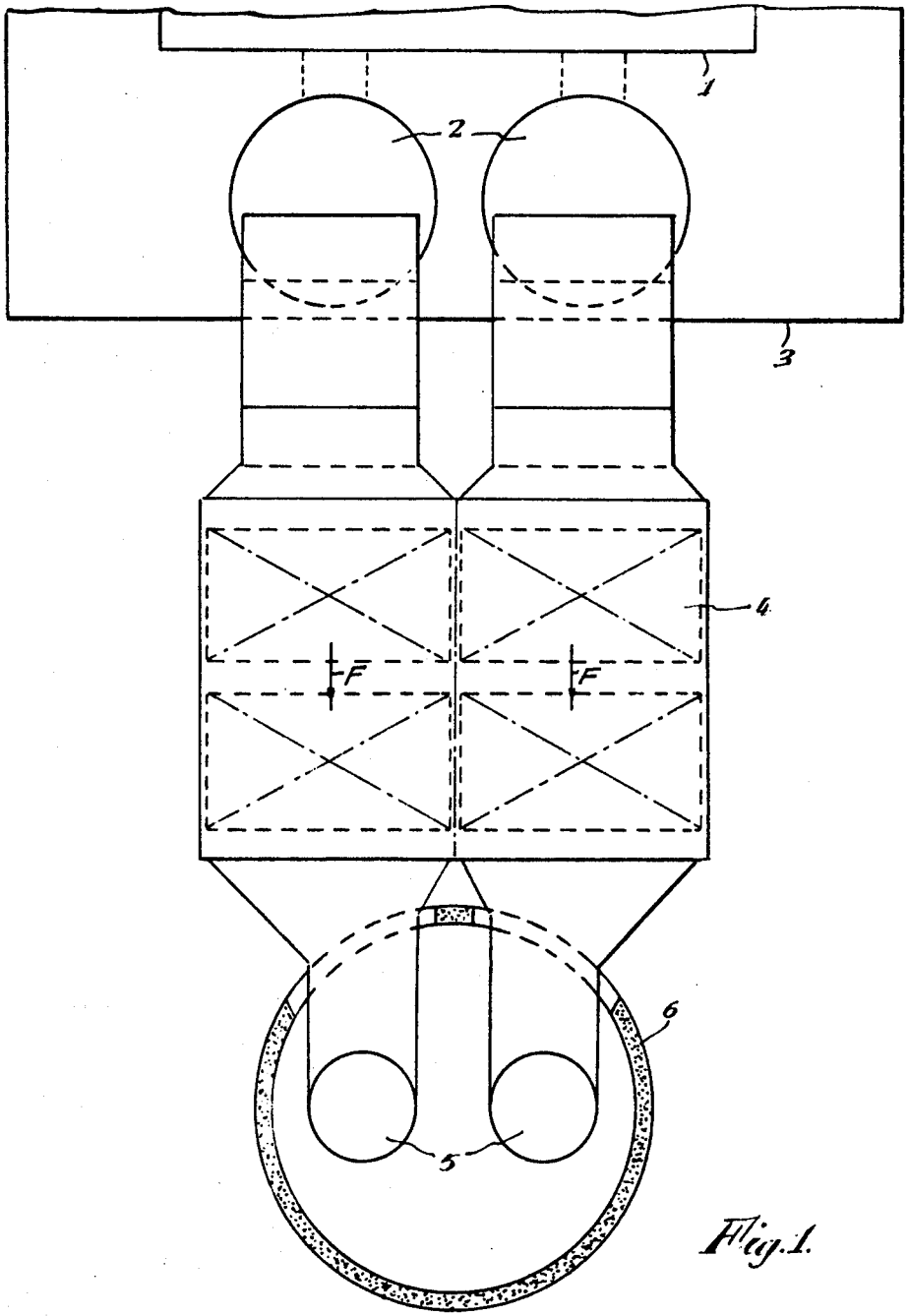
FIG. 1 shows a customary prior art ground plan arrangement and construction of a horizontal-flow flue gas electrostatic filter between a boiler house and a chimney.

The prior art arrangement, seen in FIG. 1, has a boiler 1 in a boiler house 3, with its flue gases passing through rotary regenerative preheaters 2 and then in parallel through an electrostatic filter 4. The gases are divided between separate chambers of the filter 4 and in each chamber flow in the same direction, shown by arrows F, which is also the direction of the shortest distance between boiler house 3 and chimney 6. Draught fans 5 are in the base of the chimney 6.

DESCRIPTION OF A PREFERRED EMBODIMENT

Figure 2:
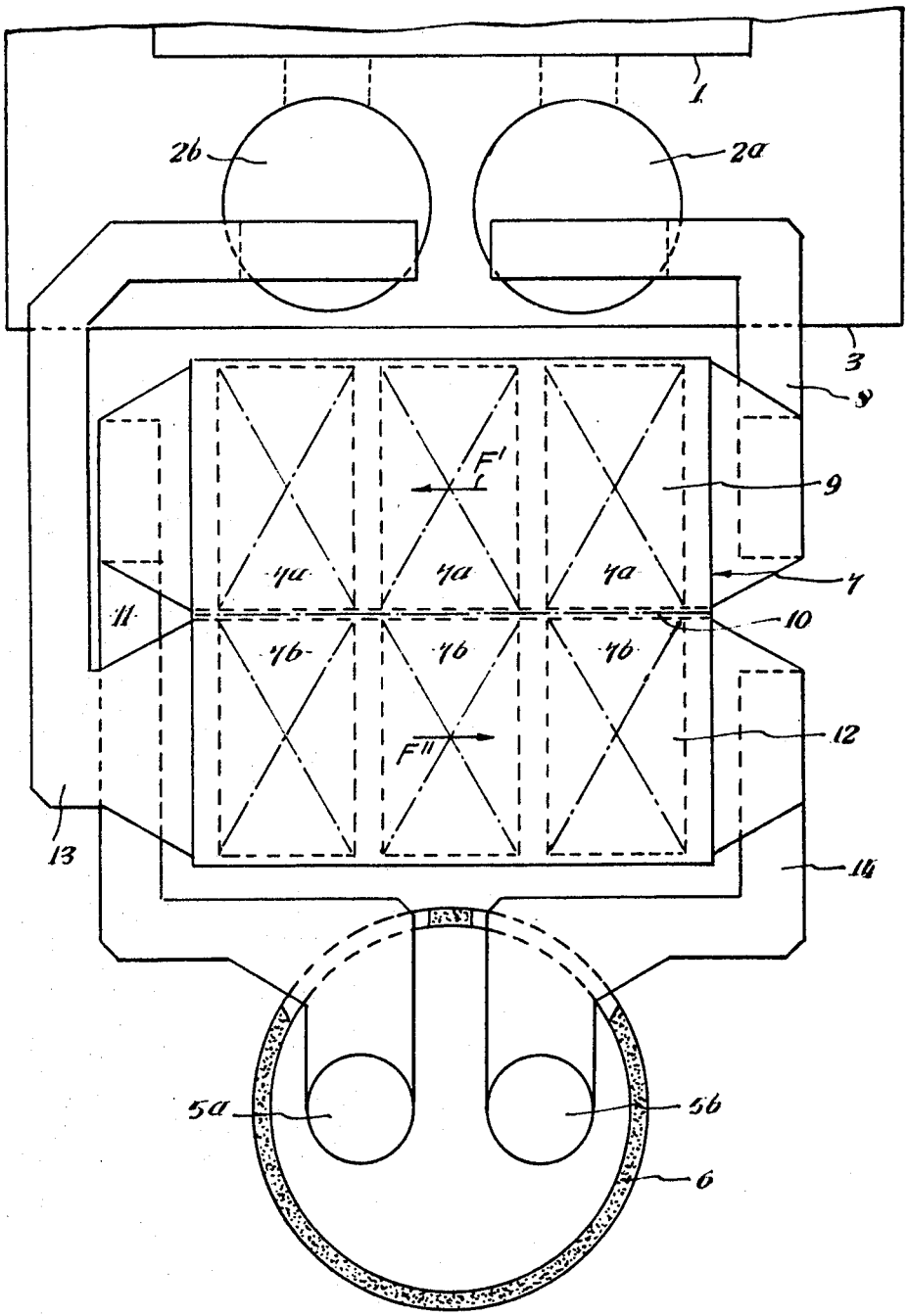
FIG. 2 shows the ground plan arrangement and construction of the electrostatic filter embodying the invention.

FIG. 2 also shows part of the steam boiler 1, at whose flue gas outlet two regenerative air preheaters 2*a*, 2*b* are disposed inside a boiler house 3. Half of the flue gases flow from the right-hand regenerative air preheater 2*a* through a right-hand gas inlet duct 8 and then from right to left in a first chamber 9 of electrostatic filter 7 which is longitudinally divided into separate and horizontally side-by-side chambers by longitudinal wall 10. The electrostatic filter 7 is installed with its longitudinal axis side disposed transversely to, preferably at right angles to, the distance between the boiler house 3 and a chimney 6. From the left-hand end of the first chamber 9 of the electrostatic filter 7 one half of the purified flue gas flows through the left-hand gas outlet duct 11 and the induced draught fan 5*a* into the chimney 6. Similarly, the inlet of the second chamber 12 of the electrostatic filter 7 is connected by inlet duct 13 to the left-hand regenerative air preheater 2*b*. The gas flows through the chamber 12 from left to right, as shown by arrows F″ i.e. in the opposite direction to the flow F′ in the first chamber, and at its outlet this second chamber 12 is connected by outlet duct 14 to the right-hand induced draught fan 5*b*.

Each of the chambers 9 and 12 has a plurality of arrays (7*a* and 7*b* respectively) of collection and discharge passed through in series by the gas flows, such arrays being separately electrically supplied and controlled.

A first electrostatic filter arranged thus may be superposed on or lie vertically under a second electrostatic filter arrangement which may be of conventional type and lie with its longitudinal axis at right angles to that of the first.

It can be seen that inlet an outlet ducts for separate chambers of the electrostatic filter casing may in many cases be disposed and installed in a spatially more favourable manner than has been possible in the prior art and that in conjunction therewith the arrangement of the electrostatic filter embodying the invention makes it possible for the filter to be accommodated in a relatively short distance between the boiler house and the chimney.

What we claim is:

1. In an electrostatic filter for treating the gases from a boiler house and passing them to a chimney, the filter having a casing with a longitudinal direction and longitudinally divided into separate gas-flow chambers each containing a plurality of arrays of collection and discharge electrodes which define a plurality of electrostatic precipitation fields in series and with gas inlet and outlet ducts for the chambers at respective longitudinal ends of the filter casing, the improvement comprising a first inlet duct extending from the boiler house to a first of said chambers and a second outlet duct for a second of said chambers extending to the chimney, the said first inlet duct and second outlet duct being at one longitudinal end of the filter casing and a first outlet duct from the first of said chambers extending to the chimney and a second outlet duct extending from the boiler house to the second of said chambers, the first outlet duct and the second inlet duct being at an opposite longitudinal end of the filter casing, whereby separate gas flows from the boiler house pass respectively through the respective chambers in opposite directions, both said directions being parallel to the longitudinal direction.

2. The improvement as claimed in claim 1 including separate electrical supply and control means for each said array.

3. The improvement as claimed in claim 1 including respective regenerators connected respectively to the first and second inlet ducts and respective fans connected respectively to the first and second outlet ducts, the said regenerators being adjacent each other in the boiler house and the said fans being adjacent each other in the chimney.

4. The improvement as claimed in claim 3 wherein the said longitudinal direction is at right angles to the closest distance between boiler house and the chimney.

5. The improvement as claimed in claim 3 wherein a flow path of a first portion of output gas from the boiler to the chimney includes in succession a first said regenerator, the first inlet duct, a first plurality of precipitation fields in series in the said first chamber, the first outlet duct and a first said fan while a flow path of a second portion of the output gas includes in succession a second said regenerator, the second input duct, a second plurality of precipitation fields in series in the second said chamber, the second output duct and a second said fan, the first outlet duct and second inlet duct being at one longitudinal end of the electrostatic filter and the second outet duct and the first inlet duct being at an opposite longitudinal end of the electrostatic filter.

6. The improvement as claimed in claim 5 wherein each precipitation field has its own separate electrical supply and electrical control means.

7. A horizontal-flow electrostatic filter interconnected between a boiler house of a steam generating plant and a chimney for treating the gas output of the boiler house and including ducting for passing treated gas to the chimney of the plant, the filter comprising a housing defining a plurality of separate horizontally extending gas-flow chambers each terminating at longitudinal ends of the housing, each chamber containing a plurality of arrays of collection and discharge electrodes which define a plurality of electrostatic precipitation fields arranged in series for the passage therethrough sequentially of gas in each chamber in parallel directions, input duct means for each chamber for bringing the gas output of the boiler house to the chambers and dividing it among them, said input duct means being at one longitudinal end of the housing for one of the chambers and at the other longitudinal end of the housing for another of the chambers, and output duct means for bringing the treated gas from the chambers to be reunited in the chimney, output duct means for the one of the chambers being at the other longitudinal end of the housing and output duct means for the other of the chambers being at the one end of the housing whereby the directions of glow through the chambers are parallel and opposite and the gas output of the boiler house is treated in a plurality of substantially equal streams totalling the said output, one stream to each chamber.

8. An electrostatic filter according to claim 7 wherein each stage has electrical supply and control means independent of each other.

9. An electrostatic filter according to claim 7, connected in parallel to a second said horizontal-flow electrostatic filter, the two electrostatic filters being disposed one above the other.

10. An electrostatic filter according to claim 9 wherein the longitudinal directions of the two electrostatic filters are disposed at right angles to one another.

11. An electrostatic filter according to claim 7 arranged with its longitudinal direction transverse to the direction between a boiler house from which the gas issues to the filter and a chimney to which it passes from the filter.

12. An electrostatic filter according to claim 11 wherein the length of the input duct means plus output duct means of the one chamber is equal to the length of the input duct means plus output duct means of the other chamber.

* * * * *

UNITED STATES PATENT AND TRADEMARK OFFICE

CERTIFICATE OF CORRECTION

PATENT NO. : 4,097,252

DATED : June 27, 1978

INVENTOR(S) : Franz-Josef Kirchhoff et al.

It is certified that error appears in the above-identified patent and that said Letters Patent are hereby corrected as shown below:

Column 3, line 6, "an" should read --and--

Column 3, line 31, "outlet" should read --inlet--

Column 4, line 4, "outet" should read --outlet--

Column 4, line 34, "glow" should read --flow--

Signed and Sealed this

*Eighth* Day of *May 1979*

[SEAL]

*Attest:*

RUTH C. MASON
*Attesting Officer*

DONALD W. BANNER
*Commissioner of Patents and Trademarks*